US011059619B2

(12) United States Patent
Hasegawa et al.

(10) Patent No.: US 11,059,619 B2
(45) Date of Patent: Jul. 13, 2021

(54) BOTTLE CAN AND BOTTLE CAN WITH CAP

(71) Applicant: TOYO SEIKAN CO., LTD., Tokyo (JP)

(72) Inventors: Toshiyuki Hasegawa, Kanagawa (JP); Masaomi Tamura, Tokyo (JP); Tomohiko Nakamura, Kanagawa (JP); Nobuhiro Sasajima, Kanagawa (JP); Takeshi Murase, Kanagawa (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 0 days.

(21) Appl. No.: 16/641,158

(22) PCT Filed: Jul. 26, 2018

(86) PCT No.: PCT/JP2018/028005
§ 371 (c)(1),
(2) Date: Feb. 21, 2020

(87) PCT Pub. No.: WO2019/039184
PCT Pub. Date: Feb. 28, 2019

(65) Prior Publication Data

US 2021/0139184 A1 May 13, 2021

(30) Foreign Application Priority Data

Aug. 25, 2017 (JP) ..... JP2017-161938

(51) Int. Cl.
*B65D 1/02* (2006.01)
*B21D 51/26* (2006.01)
*B65D 41/04* (2006.01)

(52) U.S. Cl.
CPC ..... *B65D 1/0246* (2013.01); *B21D 51/26* (2013.01); *B65D 41/0435* (2013.01)

(58) Field of Classification Search
CPC .... B65D 1/0246; B65D 1/023; B65D 1/0223; B65D 41/0407; B65D 41/0435;
(Continued)

(56) References Cited

U.S. PATENT DOCUMENTS 5,765,714 A 6/1998 Nakano et al.
7,798,357 B2 9/2010 Hanafusa et al.
(Continued)

FOREIGN PATENT DOCUMENTS

CN 1162948 A 10/1997
CN 10216421 8/2012
(Continued)

OTHER PUBLICATIONS

Translation of JP 2003252321A, Hanabusa et al., Sep. 10, 2003, Figs. 1 and 2 (Year: 2003).*
(Continued)

*Primary Examiner* — Robert J Hicks
(74) *Attorney, Agent, or Firm* — Greenblum & Bernstein, P.L.C.

(57) ABSTRACT

A bottle can has a curl part at an opening end of a mouth part thereof. The curl part has an upper end curved part in which an upper part of a neck shoulder part of the mouth part is curved outward and an outer wall part extending downward from the upper end curved part. A predetermined angle at which an outer edge side of a lower end face of the outer wall part opens is formed between the lower end face of the outer wall part and the neck shoulder part. An inner edge of the lower end face comes into contact with the neck shoulder part when a downward load is applied to the curl part from above.

19 Claims, 4 Drawing Sheets

(58) Field of Classification Search
CPC .... B65D 41/04; B65D 41/02; B65D 41/0421; B21D 51/26; B21D 51/2638; B21D 51/2623; B21D 51/2615
USPC ..... 215/44, 43, 42, 341, 343, 344; 220/304, 220/288; 72/379.4; 29/422
See application file for complete search history.

(56) References Cited

U.S. PATENT DOCUMENTS

| | | | | |
|---|---|---|---|---|
| 2010/0038365 | A1* | 2/2010 | Ishida | C09J 153/025 220/304 |
| 2012/0024813 | A1 | 2/2012 | Nakagawa et al. | |
| 2013/0220964 | A1* | 8/2013 | Adams | B21D 21/00 215/44 |
| 2015/0225107 | A1 | 8/2015 | Ross et al. | |
| 2019/0329925 | A1* | 10/2019 | Aihara | B65D 1/02 |
| 2020/0172282 | A1* | 6/2020 | Hasegawa | B65D 1/0246 |

FOREIGN PATENT DOCUMENTS

| | | | | |
|---|---|---|---|---|
| CN | 104029881 | A | 9/2014 | |
| DE | 2034626 | A1 * | 2/1972 | B21D 51/2623 |
| JP | 2001-521867 | | 11/2001 | |
| JP | 2003-11979 | | 1/2003 | |
| JP | 2003-252321 | A | 9/2003 | |
| JP | 2003-321019 | | 11/2003 | |
| JP | 2004-217305 | | 8/2004 | |
| JP | 2017-512136 | | 5/2017 | |

OTHER PUBLICATIONS

Official Communication (ISR) issued in International Application No. PCT/JP2018/028005, dated Sep. 25, 2018.
Official Communication (Written Opinion) issued in International Application No. PCT/JP2018/028005, dated Sep. 25, 2018.
Office Action in Japanese patent application No. 2017-161938, dated Mar. 31, 2020, and English language translation thereof.
Office Action issued from Chinese Patent Application No. 20188005440.1 dated Jan. 25, 2021 and English Translation thereof.
Office Action in Taiwanese Application No. 107126427 dated Dec. 19, 2018, and English translation thereof.
Office Action in Taiwanese Application No. 107126427 dated Mar. 28, 2018, and English translation thereof.
Extended European Search Report issued in European Patent Application No. 18848774.8 dated Apr. 15, 2021.
Office Action issued in corresponding Korean Patent Application No. 10-2020-7004311 dated May 22, 2021, along with English Translation thereof.

* cited by examiner

- Prior Art -

BOTTLE CAN AND BOTTLE CAN WITH CAP

TECHNICAL FIELD

The present invention relates to a bottle can and a bottle can with a cap.

BACKGROUND ART

In manufacturing a bottle can, a metal plate made of aluminum or an aluminum alloy is subjected to drawing processing and ironing processing to obtain a bottomed cylindrical form body. Then, the opening part of the cylindrical form body is subjected to neck form processing to shape a shoulder part and a mouth part. In addition, the mouth part is subjected to screw form processing, and the opening end of the mouth part is subjected to curl form processing to shape a curl part.

It has been proposed that such a curl part shaped at the mouth part of a can body should have various processing forms in consideration of sealability or the like with respect to the liner material of a cap attached to the mouth part.

For example, in the related art described in the following PTL 1, a curl part shaped by folding the peripheral edge of an opening mouth part outward in a radial direction has an outer face side wall part extending in a direction substantially parallel to the can axis direction of a bottle can, an outer face side projection curved part directed inward in the radial direction from the upper end of the outer face side wall part, and an inner face side projection curved part directed further inward in the radial direction from the outer face side projection curved part. In addition, the curl part has a hook continuously provided at the lower end of the outer face side wall part and bent inward in the radial direction and downward in the can axis direction.

CITATION LIST

Patent Literature

[PTL 1] Japanese Patent Application Laid-open No. 2004-217305

SUMMARY OF INVENTION

Technical Problem

In the related art described above, the lower end edge of the hook continuously provided at the lower end of the outer face side wall part in the curl part is formed into a shape substantially parallel to the inclined surface of the mouthpiece part (neck shoulder part) of the bottle can by the folding of the hook. When the bottle can having such a curl part receives an impact due to its upside-down drop or the like in a state in which the cap having a liner material disposed on its inner face is attached to the bottle can, a dropping impact load applied to the upper end of the curl part is transmitted to the lower end face of the hook in the curl part. As a result, a phenomenon in which the entire curl part deforms in the inward direction of the bottle can with the lower end face of the hook pressing the mouthpiece part (neck shoulder part) inward occurs.

When such a phenomenon occurs, the contact part (seal point) between the curl part and the liner material inside the cap is easily separated, which causes a problem that the sealability of the bottle can with a cap in which a content is filled is degraded.

The present invention has an object of coping with such circumstances. That is, the present invention has an object of improving the shape of the curl part of a bottle can to prevent the degradation of the sealability of the bottle can with a cap in which a content is filled even when the bottle can receives an impact due to its upside-down drop or the like, or the like.

Solution to Problem

In order to solve such a problem, the present invention has the following configurations.

A bottle can having a curl part at an opening end of a mouth part thereof, wherein the curl part has an upper end curved part in which an upper part of a neck shoulder part of the mouth part is curved outward and an outer wall part extending downward from the upper end curved part, a predetermined angle at which an outer edge side of a lower end face of the outer wall part opens is formed between the lower end face of the outer wall part and the neck shoulder part, and an inner edge of the lower end face comes into contact with the neck shoulder part when a downward load is applied to the curl part from above.

Advantageous Effect of Invention

According to the present invention having such characteristics, a gap having a predetermined angle at which the outer edge side of the lower end face of an outer wall part opens is formed between the lower end face of the outer wall part of a curl part and a neck shoulder part in a bottle can. Thus, when a downward load is applied to the curl part due to the impact of an upside-down drop or the like, the inner edge of the lower end face of the outer wall part first comes into contact with the neck shoulder part. When receiving a downward load from above, the upper side of the curl part deforms so as to bend outward with the contact part as a fulcrum. When such a deformation of the curl part occurs, the curl part is pressed against a liner material inside a cap. As a result, the sealability between the liner material and the curl part is not degraded even when a dropping impact occurs.

DESCRIPTION OF EMBODIMENTS

Hereinafter, embodiments of the present invention will be described with reference to the drawings. The same symbols among different figures show the portions of the same functions, and duplicated descriptions in the respective figures will be appropriately omitted.

Figure 1:
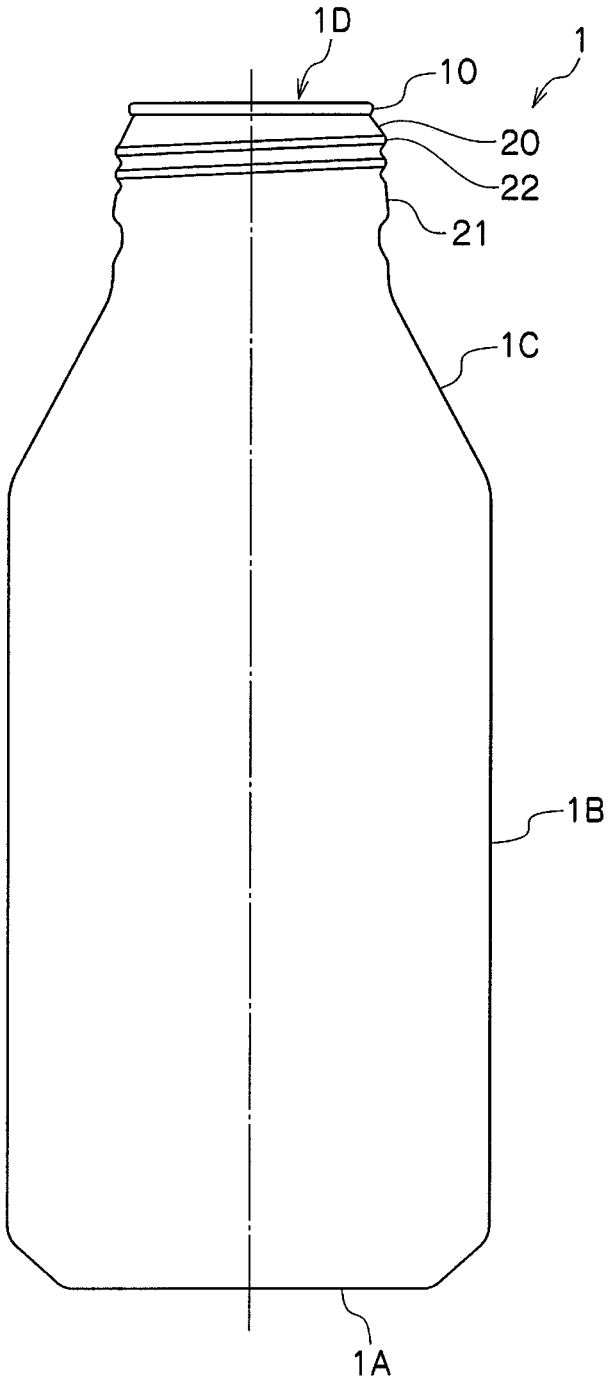
FIG. 1 is an explanatory view showing the entire configuration of a bottle can according to an embodiment of the present invention.

As shown in FIG. 1, a bottle can 1 has, for example, a bottom part 1A, a barrel part 1B, a shoulder part 1C, and a mouth part 1D. In manufacturing the bottle can 1, a metal plate made of an aluminum alloy or the like is stamped into a circular shape and subjected to drawing processing to obtain a bottomed cylindrical body. Then, the bottomed cylindrical body is subjected to redrawing processing and ironing processing to temporarily obtain a cylindrical can having a predetermined thickness. After that, the diameter of the cylindrical can is reduced by a predetermined length from an opening end by neck-in processing to shape the shoulder part 1C and the mouth part 1D. Then, a skirt part 21 and a screw part 22 are shaped at the mouth part 1D by spinning processing. Next, a neck shoulder part 20 inclined upward and inward is shaped above the screw part 22 by neck-in processing, and a curl part 10 is shaped at the opening end above the neck shoulder part 20.

Figure 2:
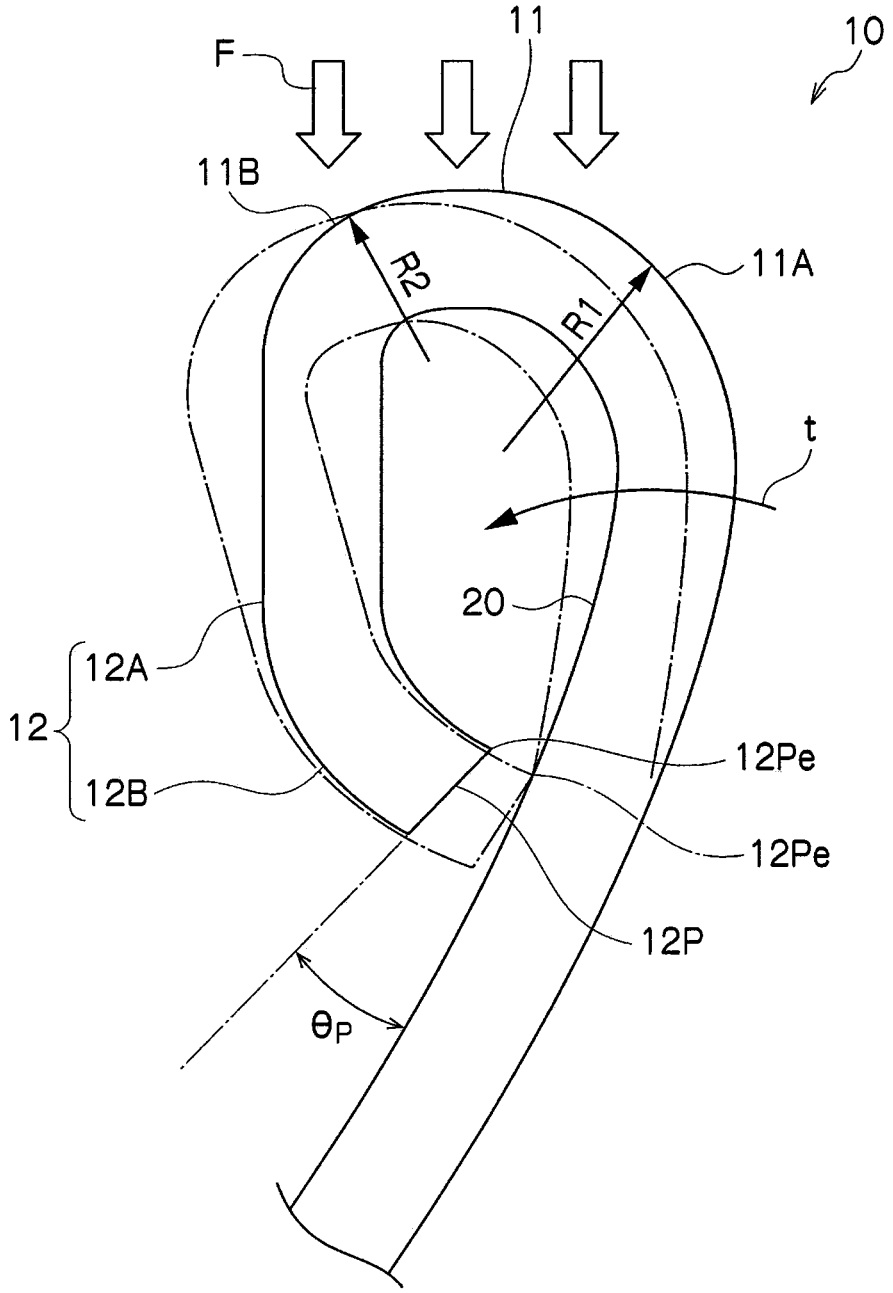
FIG. 2 is an explanatory view (sectional view) showing the curl part of the bottle can according to the embodiment of the present invention.

The curl part 10 of the bottle can 1 according to an embodiment of the present invention has a sectional shape as shown in FIG. 2. The curl part 10 has an upper end curved part 11 in which the upper part of the neck shoulder part 20 is curved outward, and also has an outer wall part 12 extending downward from the upper end curved part 11. The upper end curved part 11 has, for example, an inner curved part 11A having a radius of curvature of R1 and an outer curved part 11B having a radius of curvature of R2. In an example shown in the figure, the radius of curvature of R1 of the inner curved part 11A is greater than the radius of curvature of R2 of the outer curved part 11B.

In the example shown in the figure, the outer wall part 12 has a linearly extended part 12A provided to be linearly extended, an inward bent part 12B bent inward, and a lower end face 12P at its lower end. Further, a gap having a predetermined angle θp at which the outer edge side of the lower end face 12P of the outer wall part 12 opens is formed between the lower end face 12P of the outer wall part 12 and the neck shoulder part 20. When the neck shoulder part 20 is a curved face, it is defined that the predetermined angle θp refers to the angle between the lower end face 12P of the outer wall part 12 and a tangential line at a point on the neck shoulder part 20 in the shortest distance from an inner edge 12Pe of the lower end face 12P.

When a load F (an impact load applied when the bottle can 1 drops upside down) as indicated by outline arrows shown in the figure is applied to the curl part 10 having such an angle θp, the curl part 10 deforms with only the inner edge 12Pe of the lower end face 12P coming into contact with the neck shoulder part 20 of the mouth part 1D. In the example shown in the figure, the inner edge 12Pe is separated from the neck shoulder part 20 before deformation and comes into contact with the neck shoulder part 20 after deformation. However, the inner edge 12Pe may be formed to be in contact with the neck shoulder part 20 before the deformation, that is, at all times.

Figure 3:
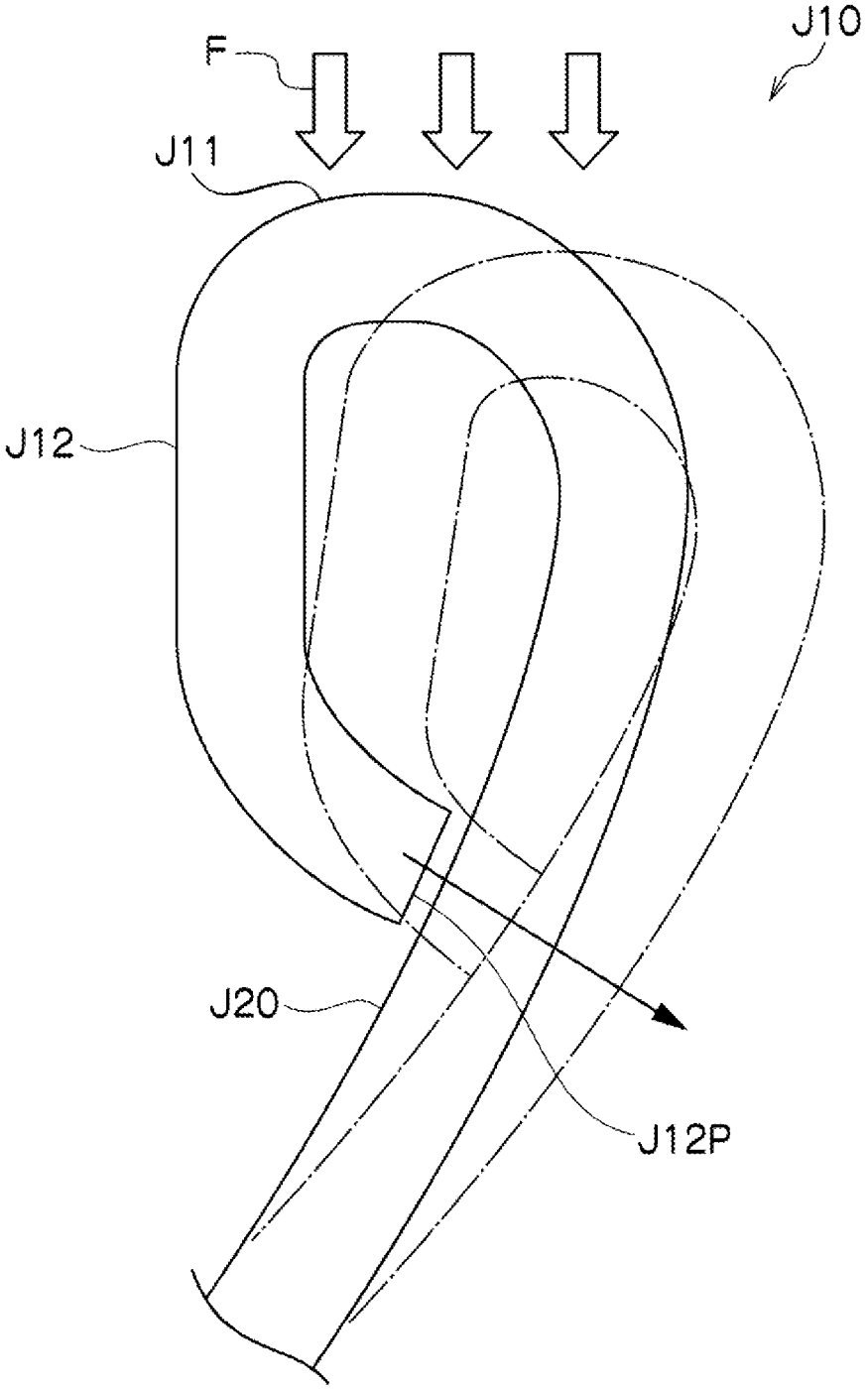
FIG. 3 is an explanatory view of a related art.

When the load F is applied to the curl part 10, the entire curl part 10 bends and deforms outward as indicated by an arrow tin the figure with the inner edge 12Pe of the lower end face 12P as a fulcrum. On the other hand, in a conventional curl part J10 as shown in FIG. 3, a lower end face J12P of an outer wall part J12 and a neck shoulder part J20 are substantially parallel to each other. Therefore, when a load F is applied to an upper end curved part J11, the lower end face J12P of the outer wall part J12 comes in face contact with the neck shoulder part J20. That is, the load F presses the neck shoulder part J20 by a face via the outer wall part J12. As a result, the neck shoulder part J20 deforms so as to fall inward, and the seal point of the curl part 10 shifts inward.

Figure 4:
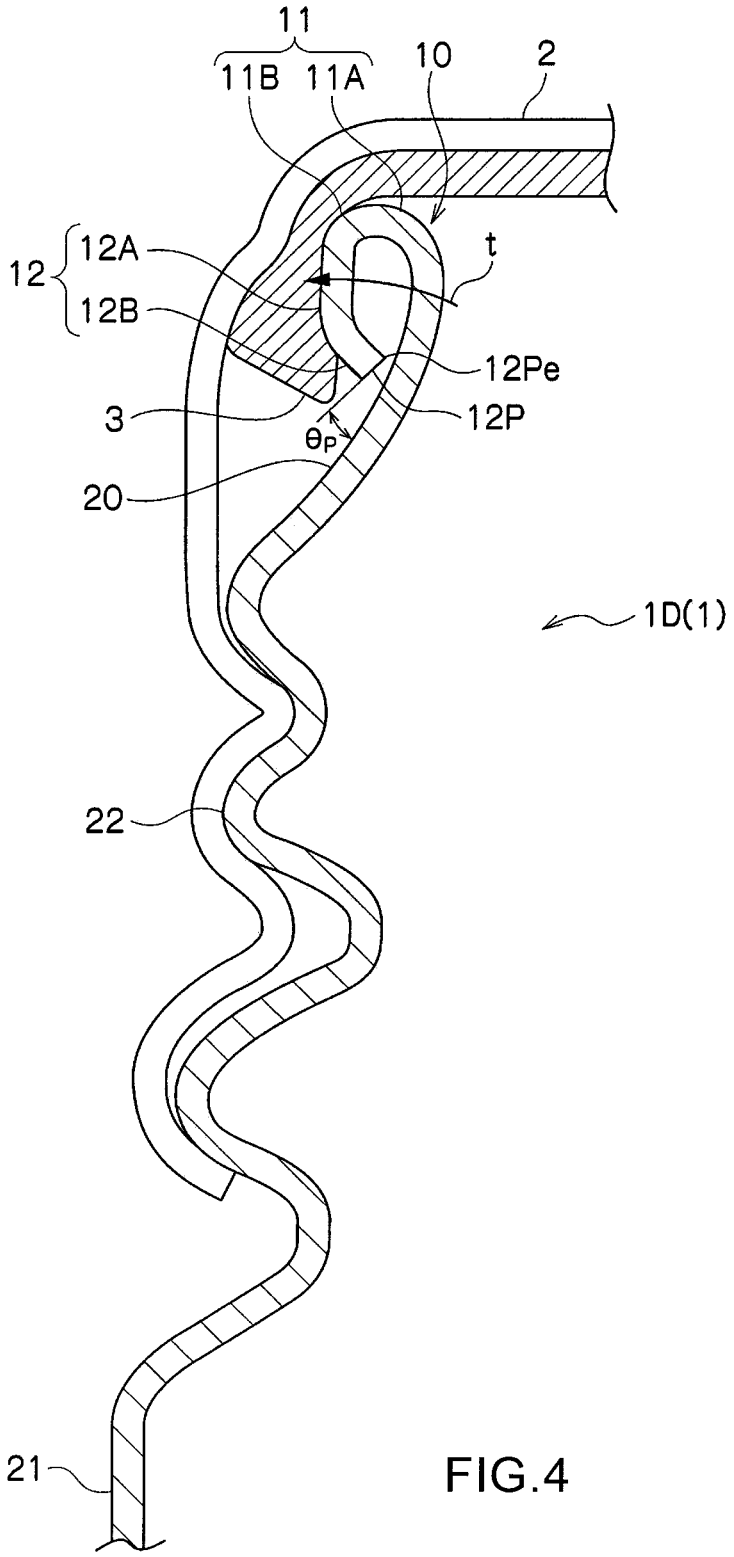
FIG. 4 is an explanatory view showing a bottle can with a cap according to an embodiment of the present invention.

FIG. 4 shows a bottle can with a cap according to an embodiment of the present invention. The bottle can with a cap has a cap 2 tightened against the mouth part 1D of the bottle can 1 having the curl part 10 described above. The cap 2 has a liner material 3 inside its top plate part. In an example shown in the figure, the liner material 3 of the tightened cap 2 is attached so as to cover a part of the outer wall part 12 of the curl part 10.

In the example shown in the figure, when a load is applied to the upper end curved part 11 of the curl part 10 as described above, the curl part 10 bends and deforms outward with the inner edge 12Pe of the lower end face 12P as a fulcrum as indicated by an arrow tin the figure as described above. Therefore, the outer curved part 11B or the like that is in contact with the liner material 3 in the curl part 10 is further pressed to the side of the liner material 3. As a result, a problem that the curl part 10 and the liner material 3 are separated from each other by the deformation of the curl part 10 hardly occurs. Therefore, the bottle can with a cap according to the embodiment of the present invention hardly causes, even when receiving a dropping impact or the like, degradation in sealability by which a content is leaked. Note that as a method for evaluating a leakage due to a dropping impact, a method in which the bottle can is dropped from a height of 30 cm at an inclination angle of 10° in its upside-down state has been generally performed.

The deformation of the curl part 10 that does not degrade the sealability even with the dropping impact described above can be effectively obtained when the angle θp is set at a predetermined angle. If the angle θp is too small, the curl part 10 deforms with the lower end face 12P pressing down the neck shoulder part 20 like the related art shown in FIG. 3. If the angle θp is too large, the dropping impact is released in a can axis direction. As a result, the entire curl part 10 becomes hardly bendable and deformable outward. Therefore, the angle θp is preferably set at 10° to 90° (more preferably set at 30° to 60°). Note that formation becomes difficult if the angle θp exceeds 90° or more.

Further, the gap between the inner edge 12Pe of the lower end face 12P having the predetermined angle θp of the outer wall part 12 and the neck shoulder part 20 is preferably 0.3 mm or less (more preferably 0 mm (contact)) before the deformation. If the gap exceeds 0.3 mm, the inner edge 12Pe of the lower end face 12P of the outer wall part 12 hardly comes into contact with the neck shoulder part 20 when the load is applied to the upper end curved part 11 of the curl part 10. As a result, it becomes difficult for the curl part 10 to bend and deform outward with the inner edge 12Pe as a fulcrum. Therefore, it becomes difficult to further press the outer curved part 11B or the like that is in contact with the liner material 3 in the curl part 10 described above to the side of the liner material 3 to prevent a problem that the curl part 10 and the liner material 3 are separated from each other by the deformation of the curl part 10.

Note that as described above, the inner edge 12Pe may be formed to be in contact with the neck shoulder part 20 before the deformation, that is, at all times.

In addition, in order to cause the curl part 10 that bends and deforms outward by the load F to be appropriately pressed against the liner material 3 and properly maintain the sealability of the bottle can with a cap, the radius of curvature of the inner curved part 11A is preferably greater than that of the outer curved part 11B in the curl part 10 that is in contact with the liner material 3. Among the load F applied to the curl part 10, a load applied to the outer curved part 11B acts in a direction in which the curl part 10 is fallen inward, while a load applied to the inner curved part 11A acts in a direction in which the curl part 10 is fallen outward. Therefore, when the radius of curvature of the inner curved part 11A is greater than that of the outer curved part 11B, a force in the direction in which the curl part 10 is fallen outward by the load F becomes greater. As a result, the curl part 10 is more appropriately pressed against the liner material 3. Here, when the radius of curvature of the inner curved part 11B is 0.5 to 2 mm, the radius of curvature of the outer curved part 11B is preferably 0.3 mm to 0.8 mm.

The embodiments of the present invention are described in detail above with reference to the drawing. However, specific configurations are not limited to the embodiments, and modification in design or the like is included in the present invention without departing from the spirit of the present invention. Further, it is possible to apply and combine the mutual technologies of the respective embodiments described above together unless any contradiction or problem occurs in their purposes, configurations, or the like.

REFERENCE SIGNS LIST

1: Bottle can
1A: Bottom part
1B: Barrel part
1C: Shoulder part
1D: Mouth part
2: Cap
3: Liner material
10: Curl part
11: Upper end curved part
11A: Inner curved part
11B: Outer curved part
12: Outer wall part
12A: Linearly extended part
12B: Inward bent part
12P: Lower end face
12Pe: Inner edge
20: Neck shoulder part
21: Skirt part
22: Screw part

The invention claimed is:

1. A bottle can having a curl part at an opening end of a mouth part thereof, wherein the curl part has an upper end curved part in which an upper part of a neck shoulder part of the mouth part is curved outward and an outer wall part extending downward from the upper end curved part, a predetermined angle at which an outer edge side of a lower end face of the outer wall part opens is formed between the lower end face of the outer wall part and the neck shoulder part, and an inner edge of the lower end face comes into contact with the neck shoulder part when a downward load is applied to the curl part from above.

2. The bottle can according to claim 1, wherein the angle is 10° to 90°.

3. The bottle can according to claim 1, wherein a gap between the inner edge and the neck shoulder part is 0.3 mm or less before deformation.

4. The bottle can according to claim 2, wherein a gap between the inner edge and the neck shoulder part is 0.3 mm or less before deformation.

5. The bottle can according to claim 1, wherein the inner edge is in contact with the neck shoulder part at all times.

6. The bottle can according to claim 2, wherein the inner edge is in contact with the neck shoulder part at all times.

7. The bottle can according to claim 1, wherein the upper end curved part has an inner curved part and an outer curved part, and a radius of curvature of the inner curved part is greater than a radius of curvature of the outer curved part.

8. The bottle can according to claim 2, wherein the upper end curved part has an inner curved part and an outer curved part, and a radius of curvature of the inner curved part is greater than a radius of curvature of the outer curved part.

9. The bottle can according to claim 3, wherein the upper end curved part has an inner curved part and an outer curved part, and a radius of curvature of the inner curved part is greater than a radius of curvature of the outer curved part.

10. The bottle can according to claim 4, wherein the upper end curved part has an inner curved part and an outer curved part, and a radius of curvature of the inner curved part is greater than a radius of curvature of the outer curved part.

11. The bottle can according to claim 5, wherein the upper end curved part has an inner curved part and an outer curved part, and a radius of curvature of the inner curved part is greater than a radius of curvature of the outer curved part.

12. The bottle can according to claim 6, wherein the upper end curved part has an inner curved part and an outer curved part, and a radius of curvature of the inner curved part is greater than a radius of curvature of the outer curved part.

13. The bottle can according to claim 7, wherein the radius of curvature of the inner curved part is 0.5 mm to 2 mm, and the radius of curvature of the outer curved part is 0.3 to 0.8 mm.

14. The bottle can according to claim 8, wherein the radius of curvature of the inner curved part is 0.5 mm to 2 mm, and the radius of curvature of the outer curved part is 0.3 to 0.8 mm.

15. The bottle can according to claim 9, wherein the radius of curvature of the inner curved part is 0.5 mm to 2 mm, and the radius of curvature of the outer curved part is 0.3 to 0.8 mm.

16. The bottle can according to claim 10, wherein the radius of curvature of the inner curved part is 0.5 mm to 2 mm, and the radius of curvature of the outer curved part is 0.3 to 0.8 mm.

17. The bottle can according to claim 11, wherein the radius of curvature of the inner curved part is 0.5 mm to 2 mm, and the radius of curvature of the outer curved part is 0.3 to 0.8 mm.

18. The bottle can according to claim 12, wherein the radius of curvature of the inner curved part is 0.5 mm to 2 mm, and the radius of curvature of the outer curved part is 0.3 to 0.8 mm.

19. A bottle can with a cap against which a cap having a liner material for covering the curl part in the bottle can according to claim 1 is tightly screwed.

* * * * *